United States Patent [19]

Treaster

[11] Patent Number: 4,848,306

[45] Date of Patent: Jul. 18, 1989

[54] ARCHER'S BOW

[76] Inventor: Mahlon L. Treaster, R.D. #2, Box 288, Cafferty Rd., Harpursville, N.Y. 13787

[21] Appl. No.: 145,598

[22] Filed: Jan. 19, 1988

[51] Int. Cl.[4] ..... F41B 5/00

[52] U.S. Cl. ..... 124/23 R; 124/87; 124/90; 33/265

[58] Field of Search ..... 124/23 R, 24 R, 87, 124/88, 90; 33/265; 242/107

[56] References Cited

U.S. PATENT DOCUMENTS

| | | | |
|---|---|---|---|
| 3,618,586 | 11/1971 | Current et al. | 124/24 R |
| 3,665,911 | 5/1972 | Altier | 124/24 R |
| 4,011,853 | 3/1977 | Fletcher | 124/87 |
| 4,116,194 | 9/1978 | Topel | 124/87 |
| 4,552,121 | 11/1985 | Treaster | 124/87 |

FOREIGN PATENT DOCUMENTS

| | | | |
|---|---|---|---|
| 907387 | 2/1982 | U.S.S.R. | 124/23 R |

*Primary Examiner*—Randolph A. Reese
*Assistant Examiner*—John A. Ricci
*Attorney, Agent, or Firm*—Richard G. Stephens

[57] ABSTRACT

A mechanical cord winding device in the form of a reel is secured to an archer's bow to apply tension to a cord which is fastened to a bowstring device or sight in such a manner as to align the back sight of the bow with respect to the front sight thereof. The reel is used to store the cord when the bowstring is displaced less than a predetermined distance from the bow. The reel is enclosed by a housing.

10 Claims, 3 Drawing Sheets

ARCHER'S BOW

BACKGROUND OF THE INVENTION

My invention relates to an archer's bow and, more particularly, to an archer's bow having a device for extending, retracting and storing a cord disposed between the bow and the bowstring.

Various prior art back sights have no strings attached to a front mounted mechanism to align them with a front sight. Conventional back sights must be aligned by a careful manipulation of the fingers to twist the bowstring when drawing an arrow to aim and shoot. While such operations require practice and skill, there is always the greater chance of failure to align the back sight with the front sight properly under crucial situations, such as may arise in the field when hunting or competing.

U.S. Pat. No. 4,552,121 issued to the present application and herein incorporated by reference teaches the use of an extensible cord connected between a back sight and a point on a bow slightly above the front sight for keeping the back sight aimed in the desired forward direction. More specifically, the aforementioned patent discloses means by which injury may be averted if the cord breaks or loosens from its attachment to the bow.

The problem still remains, however, that when the bowstring is in a relaxed position, not displaced from the bow (e.g., during storage, transportation or simply when not shooting arrows) the cord tends to hang loosely and may threaten to entangle the archer and the arrows.

Another problem relates to many archers' desire for better accuracy in shooting arrows. To aid in solving this problem, an archer must be careful to pull the arrows back to the same position each time an arrow is to be released. This has proved to be difficult under various conditions and over a relatively long period of time.

One object of the present invention is to provide an improved mechanism to align a bowstring mounted back sight with the front sight of the bow in which the mechanism does not pose a safety hazard to the archer.

Another object of the present invention is to provide a means to limit bowstring displacement every time it is drawn back to shoot an arrow in order to increase predictability of an archer's performance.

Other objects of the invention will in part be obvious and will in part appear hereinafter.

SUMMARY OF THE INVENTION

In accordance with the present invention, a mechanical cord winding device is provided in the form of a reel, which is secured to an archer's bow to apply tension to a cord which is fastened to a bowstring device or sight in such a manner as to align the back sight of the bow with respect to the front sight thereof. The reel is used to store the cord when the bowstring is displaced less than a predetermined distance from the bow. The reel is enclosed by a housing.

The invention accordingly comprises the features of construction, combination of elements, and arrangement of parts, which will be exemplified in the constructions hereinafter set forth, and the scope of the invention will be indicated in the claims.

BRIEF DESCRIPTION OF THE DRAWINGS

For a fuller understanding of the nature and objects of the invention reference should be made to the following detailed description taken in connection with the accompanying drawings, in which.

DESCRIPTION OF THE PREFERRED EMBODIMENT

Figure 1:
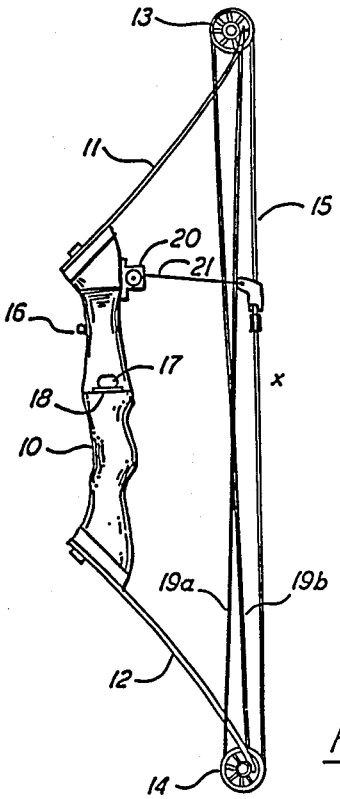
FIG. 1 is a side elevation view showing a known form of bow equipped with a cord winding mechanism of the invention, with the bow shown in a relaxed position.

Referring now to FIG. 1, a known form of compound bow is shown in a relaxed position. The bow comprises an essentially rigid central handle member 10, to which upper and lower leaf spring members 11, 12 are bolted. Pulley 13 is mounted on the upper end of leaf spring 11, and pulley 14 is mounted on the lower end of leaf spring 12. A conventional bowstring 15 is connected to cables at the pulleys 13, 14 to extend therebetween. Conventional cross cables 19a, 19b extend between pulleys 13, 14. A brush-like arrow-rest pad is shown at 18, and another pad at 17. Handle member 10 also carries a conventional front sight 16. As thus far described the bow is completely conventional, and is shown as comprising a commercially-available type sold under the trademark "X-Cellerator".

A cord winding reel 20 as hereinbelow further described is fastened by screws to the rear side of handle member 10 above front sight 16. A strong non-resilient cord 21 is secured to a bowstring alignment device 22. Device 22 is mounted on the bowstring 15 above a conventional back sight 22a. The other end of cord 21 is suitably and permanently affixed to cord winding device 20.

Figure 2:
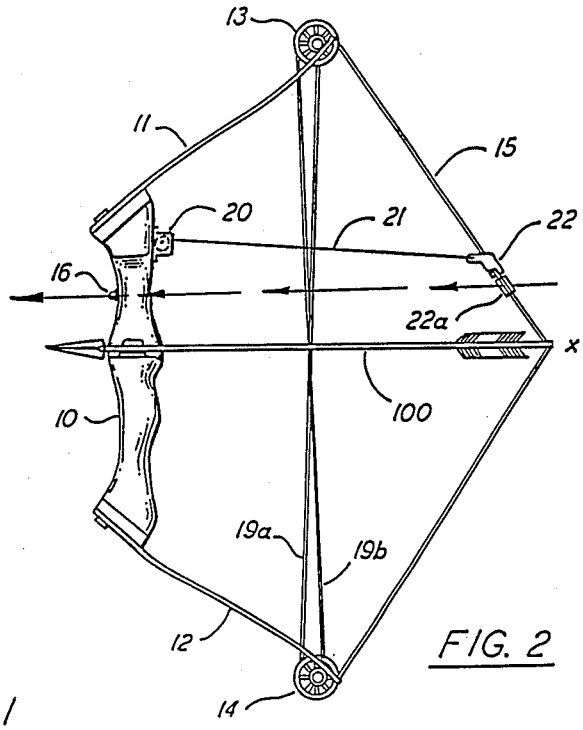
FIG. 2 is a side elevation view similar to FIG. 1 but with the bowstring drawn back and an arrow in place.

Referring now to FIG. 2, cord 21 can be extracted from cord winding device 20 when an arrow 100 is drawn back and bowstring 15 is displaced from handle 10.

Figure 3:
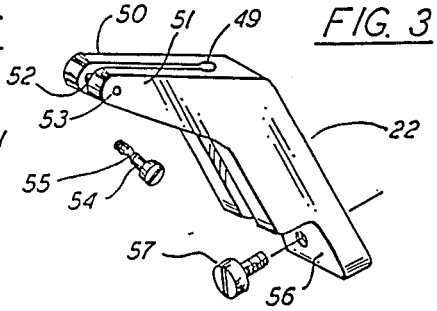
FIG. 3 is a perspective rear view of a device for attachment to a bowstring.
Figure 4:
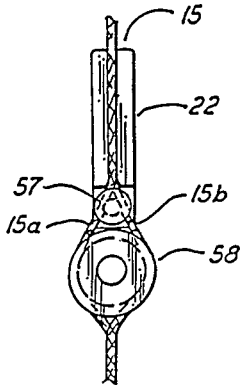
FIG. 4 is a front elevation view of the device of FIG. 3 installed on a bowstring.

Referring now also to FIG. 3, there is shown a preferred form of the alignment device 22. This device 22 snaps or slides onto bowstring 15 by means of a slot 49 to receive bowstring 15. Two arm members 50, 51 are capable of being spread apart to receive bowstring 15. Two bore holes 52, 53 are provided as an anchor for tying cord 21. Bore holes 52, 53 may be enlarged and hole 52 may be threaded to receive screw 54 having a recess 55 at which cord 21 may be tied. Alignment device 22 ha a flat portion 56 to hold against separated bowstring strands 15*a*, 15*b* as seen in FIG. 4. Screw 57 holds separated bowstring strands 15*a*, 15*b* to device 22. When arm members 50, 51 are moved in a forward direction by the pull of cord 21, bowstring portions 15*a*, 15*b* move a back sight 58 into alignment with front sight 16.

Figure 5:
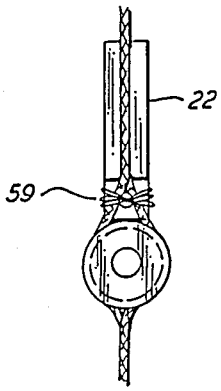
FIG. 5 is a front elevation view of the device of FIGS. 3 and 4 showing an alternative means to fasten the device to a bowstring.

Referring now to FIG. 5, an alternative means to fasten the device to sections 15*a*, 15*b* of bowstring 15 is by means of a tie string 59.

Figure 6:
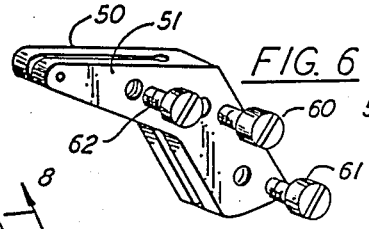
FIG. 6 is a side elevation view of an alternative embodiment of the device for attachment to a bowstring.
Figure 7:
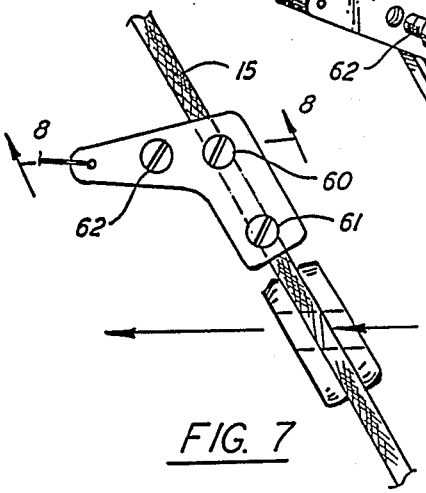
FIG. 7 is a side elevation view of the device of FIG. 6 fastened near a bowstring sight.
Figure 8:
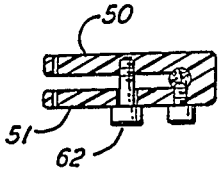
FIG. 8 is a cross-section view taken at lines 8—8 of FIG. 7.

An alternative embodiment of device 22 (FIG. 3) is shown in FIGS. 6, 7 and 8. Screws 60, 61, preferably padded, hold device 22 to bowstring 15. Screw 62 prevents arm members 50, 51 from being spread apart.

Figure 9:
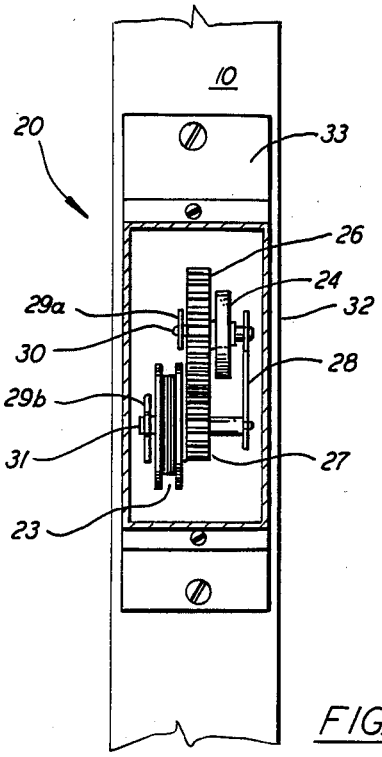
FIG. 9 is a cross-section front elevation view of a winding mechanism in accordance with the present invention.
Figure 10:
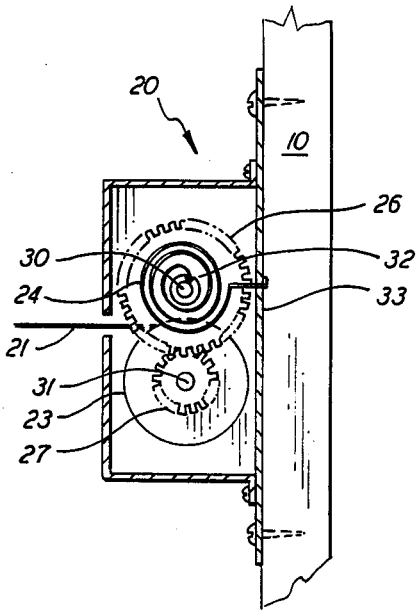
FIG. 10 is a cross-section side elevation view of a winding mechanism in accordance with the present invention.

Referring now to FIGS. 9–10, views of a preferred spring powered cord winding device 20 are shown. Flat open-coiled spring 24 is attached to gear 26. Gear 26 meshes with gear 27, which is attached to spool 23. Also attached to spool 23 by suitable means is cord 21. Mounting brackets 28, 29*a*, 29*b* retain shafts 30, 31.

FIG. 10 is a side cross-section view of cord winding device 20 with mounting bracket 28 (FIG. 9) removed. Spring 24 fits into a recess of hub 32, which is as part of gear 26. The opposite end of spring 24 fits into base 33 of cord winding device 20. Shaft 30 may be press fitted or glued by suitable adhesive into the bore of gear 26 and hub 32. Gear 26, hub 32 and shaft 30 may be plastic molded in one piece. Shaft 31 and spool 23 may be constructed in like manner. Brackets 28, 29*a*, 29*b* may be molded to base 33. By spreading apart brackets 29*a*, 29*b*, shafts 30, 31 may be inserted into holes in the brackets.

When cord 21 is withdrawn from spool 23, the spool 23 and gear 27 attached thereto turn in a counterclockwise direction (FIG. 10). Gear 27 in mesh with gear 26 causes gear 26 to turn clockwise, winding spring 24. The winding of spring 24 produces a resistance in the mechanism against cord 21. The resistance force of cord 21, secured to back sight alignment device 22 (FIG. 2) forcibly aligns device 22 with front sight 16. Conversely, the unwinding of spring 24 causes spool 23 to rewind cord 21 to its prewound condition.

Gear 26 is shown larger than gear 27. A four to one gear ratio between gears 26 and 27 is preferred. With this 4:1 ratio, gear 27 and spool 23 turn four times to each turn of spring 24 and gear 26. Twelve turns of a 0.750 inch diameter pulley 23 releases approximately 28 inches of cord 21 while turning a powerful spring 24 only three times. Cord winding spool 23 thus may have more cord winding capacity that is required for most compound bows, recurve bows or long bows.

Figure 11:
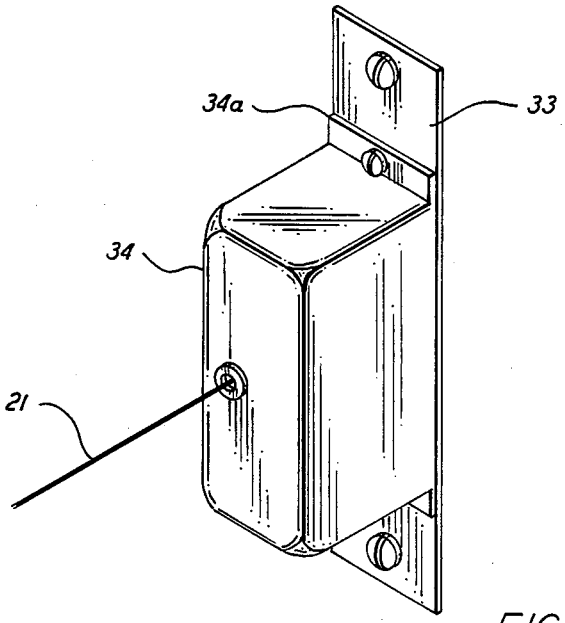
FIG. 11 is a perspective view of the winding mechanism enclosed in a housing.

Referring now to FIG. 11, a housing 34 is provided to enclose the mechanism 20 shown in FIGS. 9–10. The housing 34 may be constructed of plastic, sheet metal or any other suitable material and is mounted by screws 34*a* to base 33. Similarly, other housings may be shaped by means well known in the art to enclose the working parts of alternate embodiments of cord winding device 20.

Figure 12:
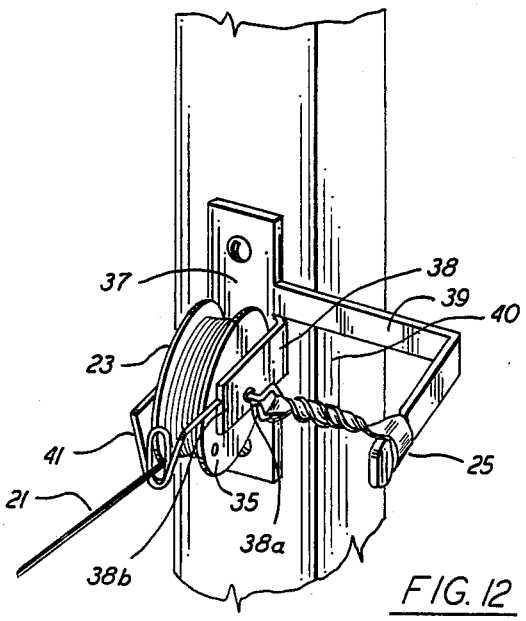
FIG. 12 is a perspective view of an alternative embodiment of the winding mechanism mechanized by an elastic band.

Referring now to FIG. 12, there is shown an alternative embodiment of the cord winding device of the present invention, powered by an elastic or rubber band 25. The frame 37 has two arm members 38, one on each side of spool 23, to retain spool 23, and an extended arm 39 to anchor rubber band 25. Shaft 40 is provided with a loop to anchor the other end of rubber band 25. Shaft 40 fits through bores 38a in arms 38 and is pressed into pulley 23. Cord line guide 41, made of spring wire, has ends glued into holes 38*b* in arms 38 by a suitable adhesive.

Figure 13:
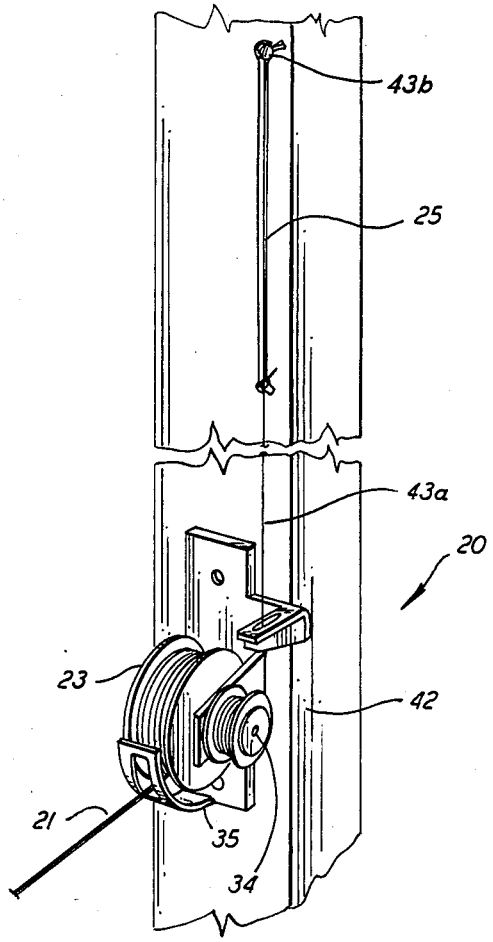
FIG. 13 is a perspective view of an alternative embodiment of the winding mechanism incorporating two cord winding spools.

Referring now to FIG. 13, cord winding mechanism 20 has one large diameter pulley 23 and one smaller diameter pulley 42 fitted together on the same shaft 34. Pulley 42 is wound with a non-resilient cord 43*a* fastened to rubber band 25. In place of rubber band 25 a closely wound torsion spring can be used. Rubber band 25 is tied to a cord 43*b*. The other end of cord 43*b* is tied to the upper bow leaf spring 11 (FIG. 1) near a point where cable portion 19*b* crosses the bow 11. Pulley 23 unwinds as cord 21 is extracted, while pulley 42 winds non-resilient cord 43*a*, overcoming resistance to rubber band 25. Because of the different diameters of pulleys 23 and 42, larger pulley 23 unwinds a greater length of cord 21 while smaller pulley 42 winds a much shorter length of non-resilient cord 43*a*.

Figure 14:
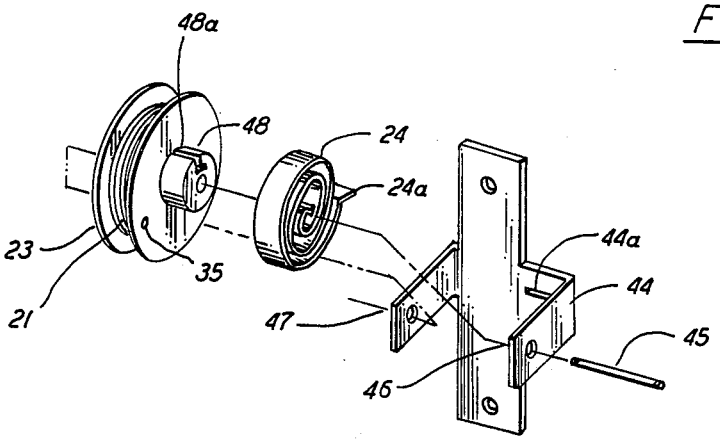
FIG. 14 is an exploded perspective assembly view of an alternative embodiment of the winding mechanism mechanized by a spring.

Referring now to FIG. 14, cord winding pulley 23 is shown with a hub 48. Hub 48 has a notch 48*a* to receive one end of spring 24. Spring 24 is connected at the other end 24*a* to a notch 44*a* in frame 44. In assembling the parts, shaft 45 presses into pulley 23, passing through holes 46, 47. Spring 24 is shown loosely coiled for illustrative purposes. Spring 24 may be made with several close wound coils at its outside diameter. When wound up, the coils of spring 24 wind closely from the inside diameter onto hub 48.

Another purpose of cord winding device 20 is to provide a predetermined length of cord 21 as a means to draw back one arrow 100 after another repeatedly to the same position. For this purpose a 36 lb. test braided Nylon cord manufactured by E. I. DuPont de Nemours Corp. has proven to be acceptable and is therefore preferred. For the short length of cord 21 needed to accommodate the length of an arrow 100, Nylon cord provides a non-stretch reliable stop. A hole 35 is drilled in spool 23 through to the groove thereof. The hole 35 is enlarged at the entrance to accommodate a knot (not shown) at the end of cord 21. When cord 21 is completely unwound from spool 23, the knot will provide a certain stop to the movement of cord 21, which is secured at the other end thereof to bowstring alignment device 22 or to a back sight. An archer, after pulling hard to draw the arrow 100 back, will feel a difference in tension when cord 21 fully unwinds from spool 23 and stops at a predetermined position as required by the predetermined length of cord 21.

While the invention has been described and illustrated to be used on a compound bow, it should be apparent that it may be used in connection with a "Recurve Bow" or the old fashioned "Long Bow". Cord 21 may also be secured directly to the back sight of a bow as described in aforementioned U.S. Pat. No. 4,552,121, which teaches the use of a non-resilient cord that, if broken, cannot snap back to strike the eye of an archer.

It will thus be seen that the objects set forth above among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

What is claimed is:

1. An archer's bow comprising:

(a) a handle having an upper extremity and a lower extremity;

(b) a bowstring disposed between said upper and said lower extremities;

(c) bowstring alignment means operatively connected to said bowstring;

(d) a cord having a first end in operative relationship to said bowstring alignment means; and (e) cord control means including a reel mounted on said handle and connected to the other end of said cord for controlling extension thereof when said bowstring is displaced from said handle.

2. The archer's bow in accordance with claim 1 wherein said cord comprises substantially inelastic material and has a predetermined length so that said bowstring is prevented from being displaced more than a predetermined distance from said handle.

3. The archer's bow in accordance with claim 1 wherein said cord control means is adpated to retract said cord when said bowstring is restored to a distance less than said predetermined distance from said handle.

4. The archer's bow in accordance with claim 1 wherein said cord control means comprises winding means operatively connected to said reel for actuation thereof.

5. The archer's bow in accordance with claim 4 wherein said winding means is spring-loaded.

6. The archer's bow in accordance with claim 5 wherein said winding means comprises a coiled flat spring.

7. The archer's bow in accordance with claim 5 wherein said winding means comprises a torsion spring.

8. The archer's bow in accordance with claim 4 wherein said winding means comprises an elastic band.

9. The archer's bow in accordance with claim 4 wherein said reel comprises a gear and said winding means comprises a gear engageable therewith.

10. The archer's bow in accordance with claim 1 further comprising a housing mounted on said handle and enclosing said cord control means for protection thereof.

* * * * *